US006371137B1

(12) United States Patent
Heath

(10) Patent No.: US 6,371,137 B1
(45) Date of Patent: Apr. 16, 2002

(54) TANK CLEANING APPARATUS

(76) Inventor: Robert A. Heath, 6 Erinville Drive, Erin, Ontario (CA), N0B 1T0

( * ) Notice: Subject to any disclaimer, the term of this patent is extended or adjusted under 35 U.S.C. 154(b) by 0 days.

(21) Appl. No.: 09/453,111

(22) Filed: Dec. 2, 1999

Related U.S. Application Data

(63) Continuation-in-part of application No. 09/205,642, filed on Dec. 3, 1998, now abandoned.

(51) Int. Cl.[7] ..... B08B 3/02

(52) U.S. Cl. ..... 134/167 R; 134/169 R; 134/172; 134/198; 239/265

(58) Field of Search ..... 134/166 R, 167 R, 134/168 R, 169 R, 172, 198, 181; 239/264, 265

(56) References Cited

U.S. PATENT DOCUMENTS

| | | | | |
|---|---|---|---|---|
| 2,569,588 A | * | 10/1951 | Terry et al. | |
| 2,943,799 A | * | 7/1960 | Bodmer | |
| 3,358,935 A | | 12/1967 | Andersen | 239/589 |
| 3,444,869 A | | 5/1969 | Guignon et al. | 134/167 R |
| 3,472,451 A | | 10/1969 | Orem et al. | 239/227 |
| 3,512,216 A | * | 5/1970 | Voelker | |
| 3,584,790 A | | 6/1971 | Bonfield | 237/227 |
| 3,645,452 A | | 2/1972 | Stoeckel et al. | 134/168 R X |
| 3,895,756 A | | 7/1975 | Jaeger | 239/227 |
| 3,916,924 A | * | 11/1975 | McGowan | |
| 4,004,736 A | * | 1/1977 | George | |
| 4,244,523 A | | 1/1981 | Looper | 239/227 |
| 4,520,514 A | * | 6/1985 | Johnson | |
| 4,716,917 A | | 1/1988 | Schmidt | 134/167 R |
| 4,756,769 A | * | 7/1988 | Booij | |
| 4,859,249 A | | 8/1989 | Valentini | 134/22.18 |
| 5,076,500 A | * | 12/1991 | Daniels | |
| 5,078,799 A | | 1/1992 | Matter et al. | 134/167 R X |
| 5,195,548 A | * | 3/1993 | Roger | 134/167 R |
| 5,301,702 A | | 4/1994 | McKinney | 137/167 R |
| 5,460,331 A | | 10/1995 | Krajicek et al. | 239/263.3 |
| 5,718,382 A | | 2/1998 | Jaeger | 239/227 |
| 5,720,310 A | | 2/1998 | Moulder | 134/167 |
| 5,810,473 A | | 9/1998 | Manabe et al. | 239/227 X |
| 5,896,871 A | | 4/1999 | Larsen | 134/167 R X |

FOREIGN PATENT DOCUMENTS

| | | | |
|---|---|---|---|
| DE | 2325110 | * 11/1974 | 134/167 R |
| EP | 0 779 111 A2 | 6/1997 | |
| JP | 08 089919 | 4/1996 | |

OTHER PUBLICATIONS

Leigh Progressive P43 Technology Brochure/Pamphlet.

European Patent Office, European Search Report for Application No. EP 00 30 1180.6 dated Apr. 10, 2001, consisting of 21 printed pages.

* cited by examiner

*Primary Examiner*—Frankie L. Stinson
(74) *Attorney, Agent, or Firm*—Tim Headley; Gardere Wynne Sewell LLP

(57) ABSTRACT

Crude oil tank cleaning apparatus includes a gimbal having a substantially straight passageway extending therethough. A mounting bracket sealingly and rotatably mounts the gimbal in a wall of the tank so that the gimbal has an interior side exposed to the interior of the tank and an exterior side exposed to the exterior of the tank. A straight pipe is sealingly mounted in the gimbal passageway. The pipe has an inlet end on the exterior side of the gimbal for connecting the pipe to a high pressure fluid source and an outlet end on the interior side of the gimbal such that the inlet and outlet ends define a linear flow passageway through the pipe for discharging the fluid in fluid jet into the tank. An actuator, mounted on the exterior of the tank, has a first end connected to a rotatable portion of the gimbal and a second end connected to a stationary portion of the tank or the mounting bracket for reciprocating the gimbal and pipe between selected positions.

16 Claims, 9 Drawing Sheets

TANK CLEANING APPARATUS

CROSS REFERENCE TO RELATED APPLICATIONS

This is a continuation-in-part application of prior application Ser. No. 09/205,642, filed on Dec. 3, 1998 now abandoned.

TECHNICAL FIELD

This invention relates generally to the cleaning of sludge from storage tanks, and more particularly to an apparatus for circulating crude oil through a crude oil storage tank to facilitate resuspension and removal of the sludge into the crude oil.

BACKGROUND AND SUMMARY OF THE INVENTION

The manufacture of petroleum-based products begins with the pumping of crude oil from one or more wells. The crude oil is directed from the wells into one or more storage tanks comprising a tank battery. The oil is then transported most commonly by pipeline to storage tanks at oil refineries prior to processing.

As will be apparent, when contained in a storage tank crude oil is in a quiescent state. This allows any solid components and the heavier liquid components comprising the crude oil to settle to the bottom of the storage tank in the form of sludge. Sludge build up in the bottom of a crude oil storage tank is undesirable for a number of reasons, the most apparent of which is reduction of the storage capacity of the tank. A number of systems have heretofore been developed to reduce sludge build up in crude oil storage tanks. Several of these techniques involve the circulation of crude oil into the bottom of the tank in an attempt to resuspend the sludge in the crude oil.

One problem that has characterized prior tank cleaning apparatus and sludge removal systems is a significant pressure drop and flow turbulence created by the perforations and/or around the ninety degree bends that exist in present jetting apparatus. Reduction in pressure and flow turbulence cause a reduction in the flow rate, or velocity, of the crude oil that is being used to resuspend the sludge, ultimately leading to a significant reduction in system efficiency.

The present invention comprises a tank cleaning apparatus which overcomes the foregoing and other problems that have long since characterized the prior art. In accordance with the broader aspects of the invention, crude oil is pumped through a long, straight passageway and is discharged therefrom through a nozzle into the bottom of a crude oil storage tank. By this means the significant pressure drop which has characterized the operation of prior sludge removal systems is eliminated. For example, the present invention has less than 50% of the pressure drop of the prior systems known to the inventor.

Also, the elimination of the sharp bends through the apparatus greatly reduces turbulence in the flow. This in turn allows for a more focused and straighter discharge from the nozzle, i.e., a laminar flow stream, which substantially increase the efficiency of the system.

Another important aspect of the invention is the location of all moving components externally of the tank, excepting the outlet end of the straight pipe and the interior side of the gimbal. The apparatus may be permanently left on the tank without concern for the apparatus becoming inoperable due to sludge buildup within the apparatus, thus providing a significant advantage over the prior sludge removal systems.

The present invention may employ reciprocating movement of the gimbal and straight pipe in one plane in order to substantially increase system efficiency.

It is an advantage of the present invention to provide a tank cleaning apparatus which does not require the tank to be removed from service for cleaning.

It is an advantage of the present invention to eliminate the need for manual cleaning or opening the tank to the outside environment during cleaning.

It is an advantage of the present invention to eliminate the cost and need for manual cleaning prior to tank inspection and servicing.

It is an advantage of the present invention to allow tank operators to decontaminate their tanks for service changes without decommissioning the tank.

It is an advantage of the present invention to operate on the tank as a closed system, eliminating the need to vent the tank to atmosphere prior to, during, or after cleaning.

It is an advantage of the present invention to allow either use of the oil from the tank itself or the use of a fluid from an outside supply source, such as a source of cutter stock, to clean the tank.

It is an advantage of the present invention to provide a tank cleaning apparatus which will interface between two dissimilar environments, i.e., the exterior, natural atmosphere outside of the tank and the interior contents of the tank, thereby eliminating the need to decommission the tank before, during, or after cleaning by permanently installing the tank cleaning apparatus on the tank.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
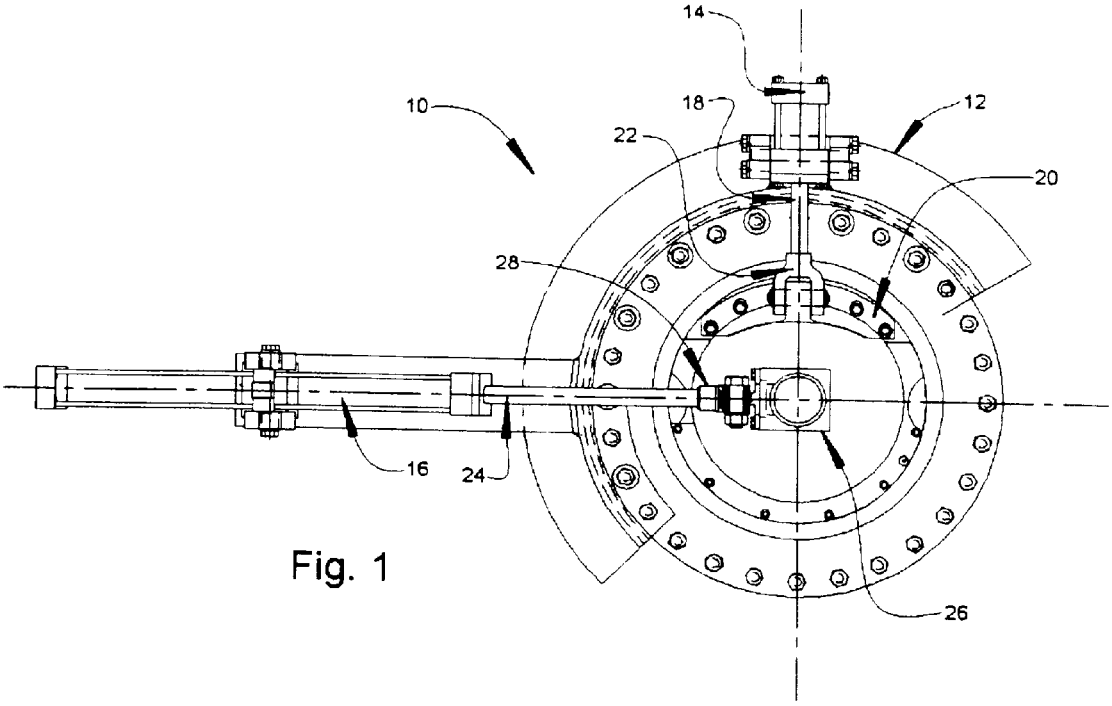
FIG. 1 is a front view of a sludge removal system incorporating the invention.

Referring now to the drawings and particularly to FIG. 1 thereof, there is shown a sludge removal system 10 comprising an embodiment of the invention. A system mounting bracket 12 supports the operating components of the sludge removal system 10, which may include an elevation hydraulic cylinder 14 and an azimuth hydraulic cylinder 16. The elevation hydraulic cylinder 14 has a piston rod 18 which is connected to an elevation bracket 20 by a clevis 22. Likewise, the azimuth hydraulic cylinder 16 has a piston rod 24 which is connected to an azimuth gimbal assembly 26 by a clevis 28.

Figure 2:
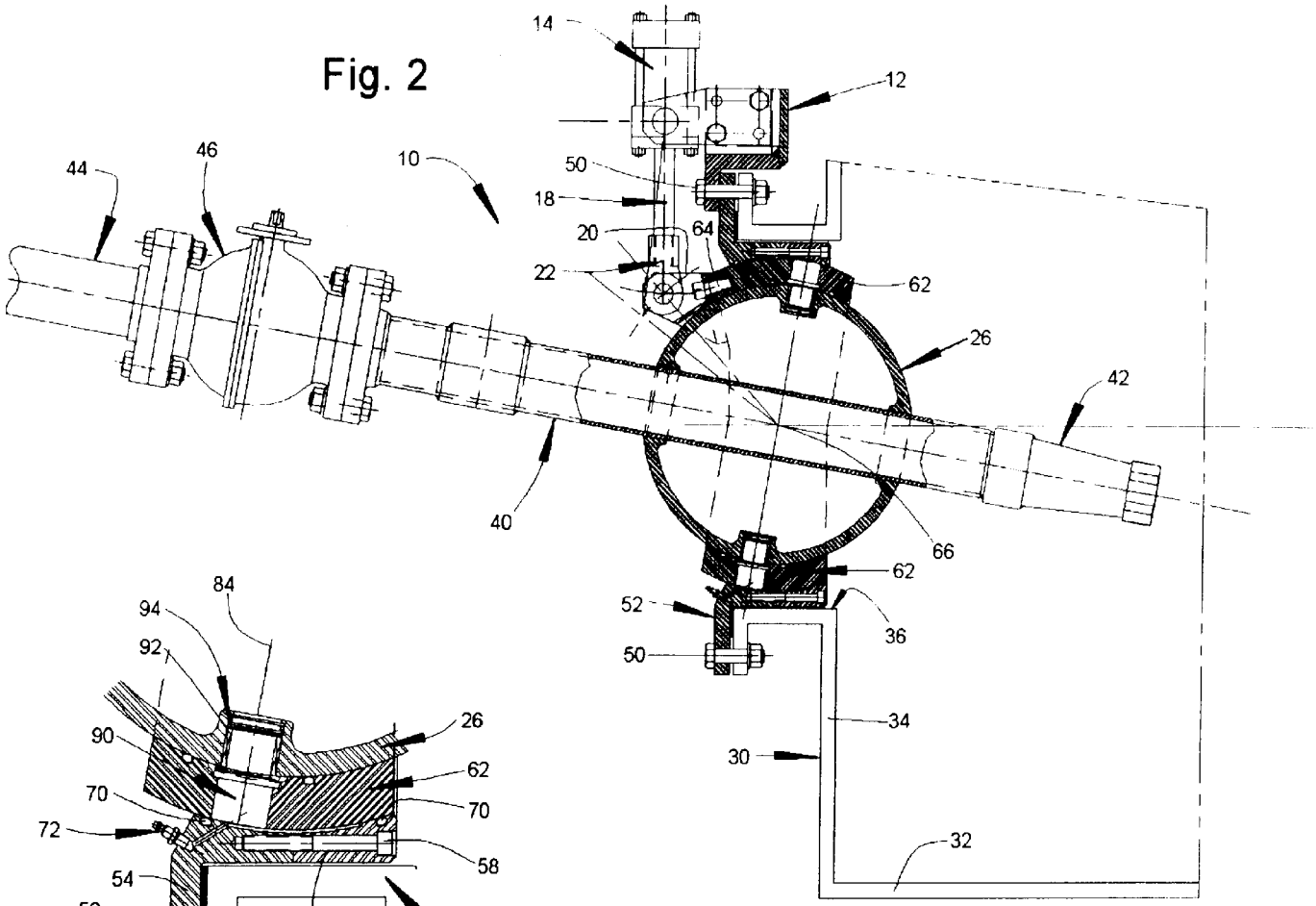
FIG. 2 is a vertical sectional view of the sludge removal system of FIG. 1.

Referring to FIG. 2, the sludge removal system 10 is utilized in a crude oil storage tank 30, it being understood that the system 10 is also adapted to other applications. The tank 30 has a bottom wall 32 and a plurality of side walls 34, only one of which is shown in detail. The side wall 34 is provided with an access port 36 having the sludge removal system 10 mounted therein. Although a particular storage tank configuration is illustrated in the Drawings, the sludge removal system 10 is adapted for use in conjunction with other types and kinds of crude oil storage tanks.

The sludge removal system 10 includes a crude oil delivery pipe 40 which extends through the azimuth gimbal assembly 26 and terminates in a nozzle 42. A pipe 40 is connected to a flexible hose 44 through a ball valve 46. In the use of the system 10, a pump (not shown in FIG. 2) withdraws crude oil from the tank 30 and directs the crude oil under high pressure through the flexible hose 44, the ball valve 46, the pipe 40, and the discharge nozzle 42. The crude oil is discharged from the nozzle 42 at high velocity into engagement with sludge formed at the bottom 32 of the tank 30, whereupon the sludge is resuspended in the crude oil contained within the tank.

It is important that the passageway comprising the flexible hose 44, the ball valve 46, the pipe 40, and the nozzle 42 define a length of at least 20 diameters that does not include obstructions such as sharp bends, perforated members, etc. in order to minimize pressure drop and thereby maximize both the flow rate and the velocity of the crude oil exiting the discharge nozzle 42. Preferably, the discharge nozzle 42 has a smooth bore to enhance the creation of a discharge jet of fluid from the nozzle 42.

Figure 3:
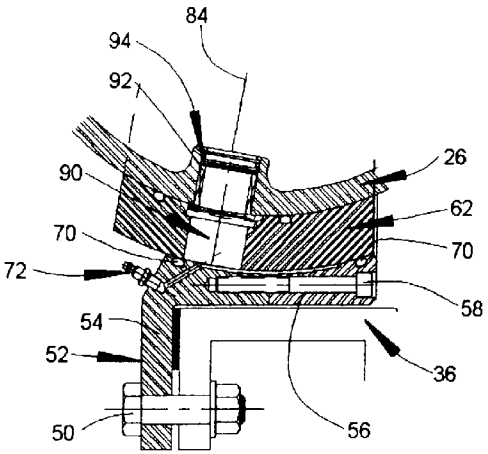
FIG. 3 is an enlargement of a portion of FIG. 2.
Figure 4:
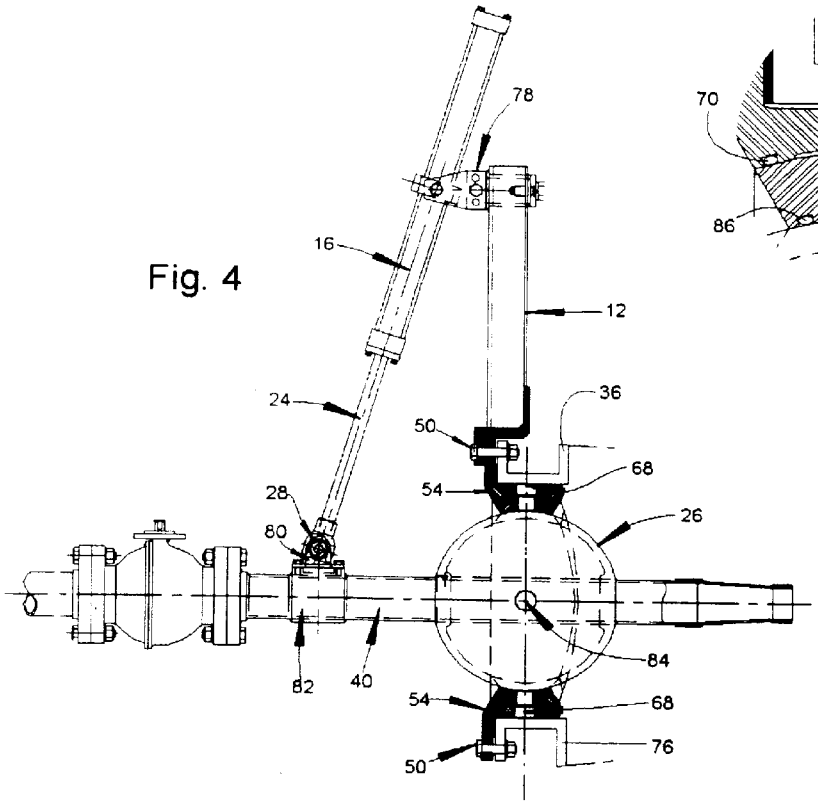
FIG. 4 is a horizontal sectional view of the sludge removal system of FIG. 1.

The system mounting bracket 12 is secured to the access port 36 by a plurality of fasteners 50 which also support a mounting flange 52. As is best shown in FIG. 3, the mounting flange 52 includes a first portion 54 which secured directly to the access port 36 and a second portion 56 which is secured to the first portion 54 by fasteners 58.

The clevis 22 connects the piston rod 18 of the elevation hydraulic cylinder 14 to the elevation bracket 20 which is secured to an elevation gimbal 62 by fastener 64. Referring again to FIG. 3, the elevation gimbal 62 supports the azimuth gimbal 26 on the mounting flange 54 for pivotal movement about a horizontal axis 66 defined by elevation pivot pins 68 (not shown in FIGS. 2 and 3). The opposite ends of the mating surfaces are provided with seals 70, and lubrication is provided to the mating surfaces through a fitting 72.

The pivot pins 68 are secured in the mounting flange 54 and rotatably support the elevation gimbal 62. Needle bearings 72 are mounted between the pivot pins 68 and the elevation gimbal 72 and serve to support the elevation gimbal 62 for pivotal movement about the axis 66 under conditions of minimal resistance. In this manner the elevational positioning of the nozzle 42 of the sludge removal system 10 is readily controlled under the action of the elevation hydraulic cylinder 14.

The azimuth hydraulic cylinder 16 is connected to the system mounting bracket 12 by a bracket 78. The clevis 28 secures the piston rod 24 of the azimuth hydraulic cylinder 16 to a bracket 80 which is in turn connected to a coupling 82 comprising part of the pipe 40. Thus, upon actuation of the azimuth hydraulic cylinder 16, the azimuth gimbal assembly 26 is caused to pivot relative to the tank 30 about an axis 84.

Figure 5:
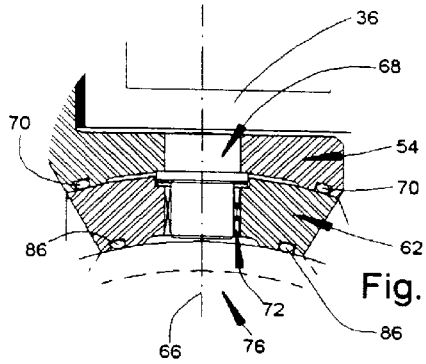
FIG. 5 is an enlargement of a portion of FIG. 4.

Referring again to FIG. 5, the azimuth gimbal assembly 26 is supported for pivotal motion relative to the elevation gimbal 62. The space between the azimuth gimbal assembly 26 and the elevation gimbal 62 is isolated by seals 86. Suitable lubrication is provided in the space between the azimuth gimbal assembly 26 and the elevation gimbal 62 by a suitable fitting (not shown).

Referring again to FIG. 3, the axis 84 is defined by the azimuth pivot pins 90 which are mounted in the elevation gimbal 62. Needle bearings 92 are mounted between the azimuth pivot pins 90 and the azimuth gimbal assembly 26 to assure pivotal movement of the azimuth gimbal assembly 26 under the action of the hydraulic cylinder 16 without undue restriction. Contamination of the bearings 92 is prevented by suitable seals 94.

Figure 6:
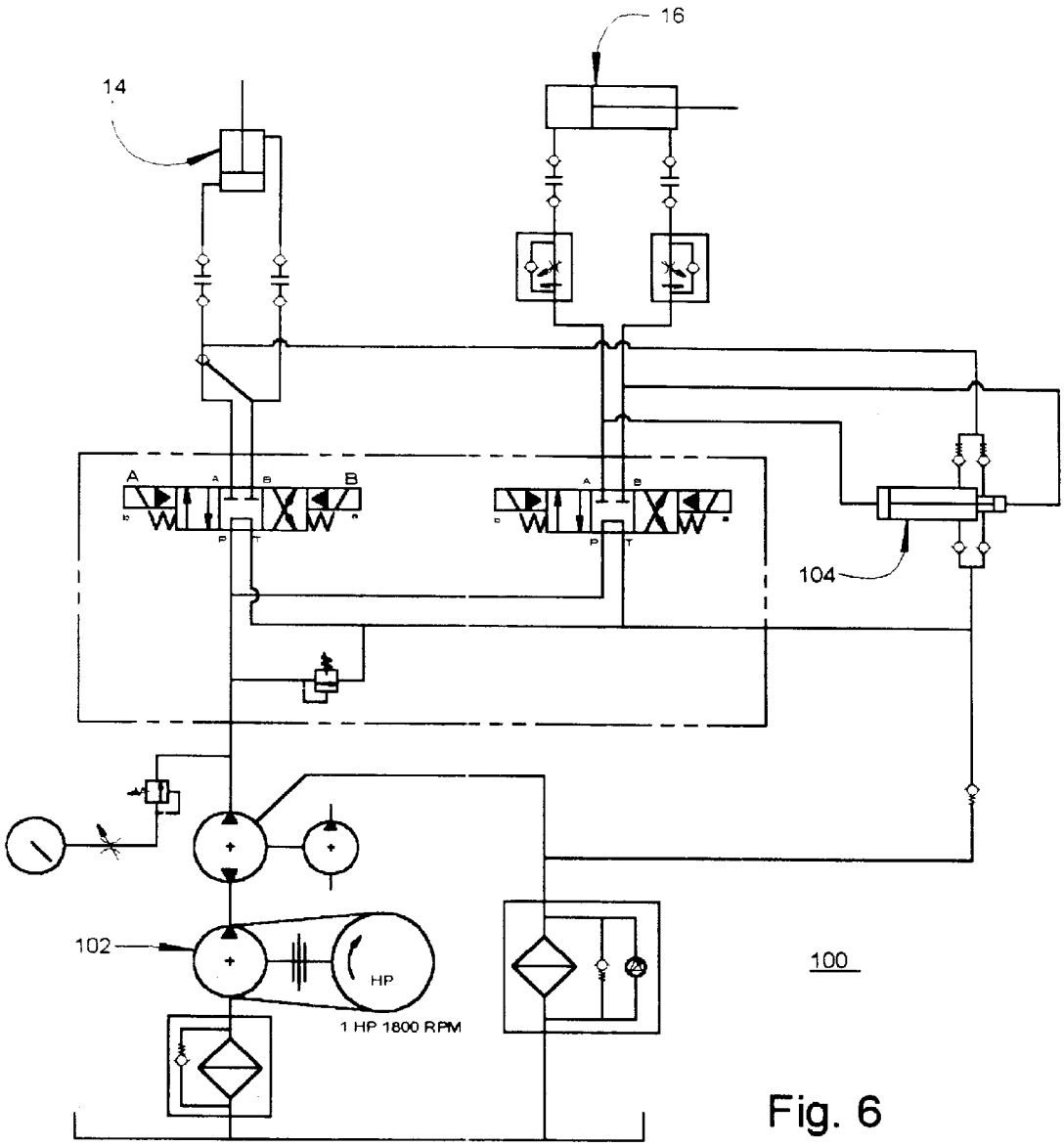
FIG. 6 is a diagrammatic illustration of a hydraulic circuit useful in the practice of the invention.

Referring now to FIG. 6, there is shown a hydraulic circuit 100 useful in the practice of the invention of FIGS. 1–5. A pump assembly 102 supplies pressurized hydraulic fluid to the elevation hydraulic cylinder 14 and the azimuth hydraulic cylinder 16 through a plurality of valves and conduits. In the operation of the hydraulic circuit 100, the azimuth hydraulic cylinder 16 is operated to sweep the nozzle 42 back and forth horizontally between the limits of its travel. The elevation hydraulic cylinder 14 is initially actuated to position the nozzle 42 at its lower most orientation relative to the tank 30. At the end of each oscillation of the azimuth hydraulic cylinder 16 an index cylinder 104 actuates the elevation hydraulic cylinder 14 to pivot the nozzle 42 upwardly one increment.

In a prototype system 10, the nozzle 42 starts operation at an angle of −10° to horizontal and indexes up one (1°) degree at the end of each horizontal sweep of nozzle 42. Preferably, the end points of each sweep of the nozzle define an angle of about 120°, and each sweep is about thirty minutes in duration. When the nozzle reaches the horizontal plane (0°), pivotal movement about the vertical axis is terminated and the nozzle is pivoted downwardly and returned to the starting point.

The indexing up of the nozzle allows for an ever-increasing sweep radius with respect to the bottom of the tank as the nozzle and sludge are swept outwardly toward the opposite side of the tank from the access port 36 and nozzle 42. By this means the sludge removal system 10 of the present invention is effective to remove sludge from a crude oil storage tank much more efficiently than has heretofore been possible.

As may be seen in FIG. 2, the ball valve 46 and 40 extending externally of the tank 30 provide an external, visual indication of the direction the nozzle 42 is discharging fluid within the tank. It is contemplated that the control system effected by the hydraulic circuit 100 may be placed on manual control so that the direction of the nozzle 42 and fluid jet discharge therefrom may be manually selected.

Figure 7:
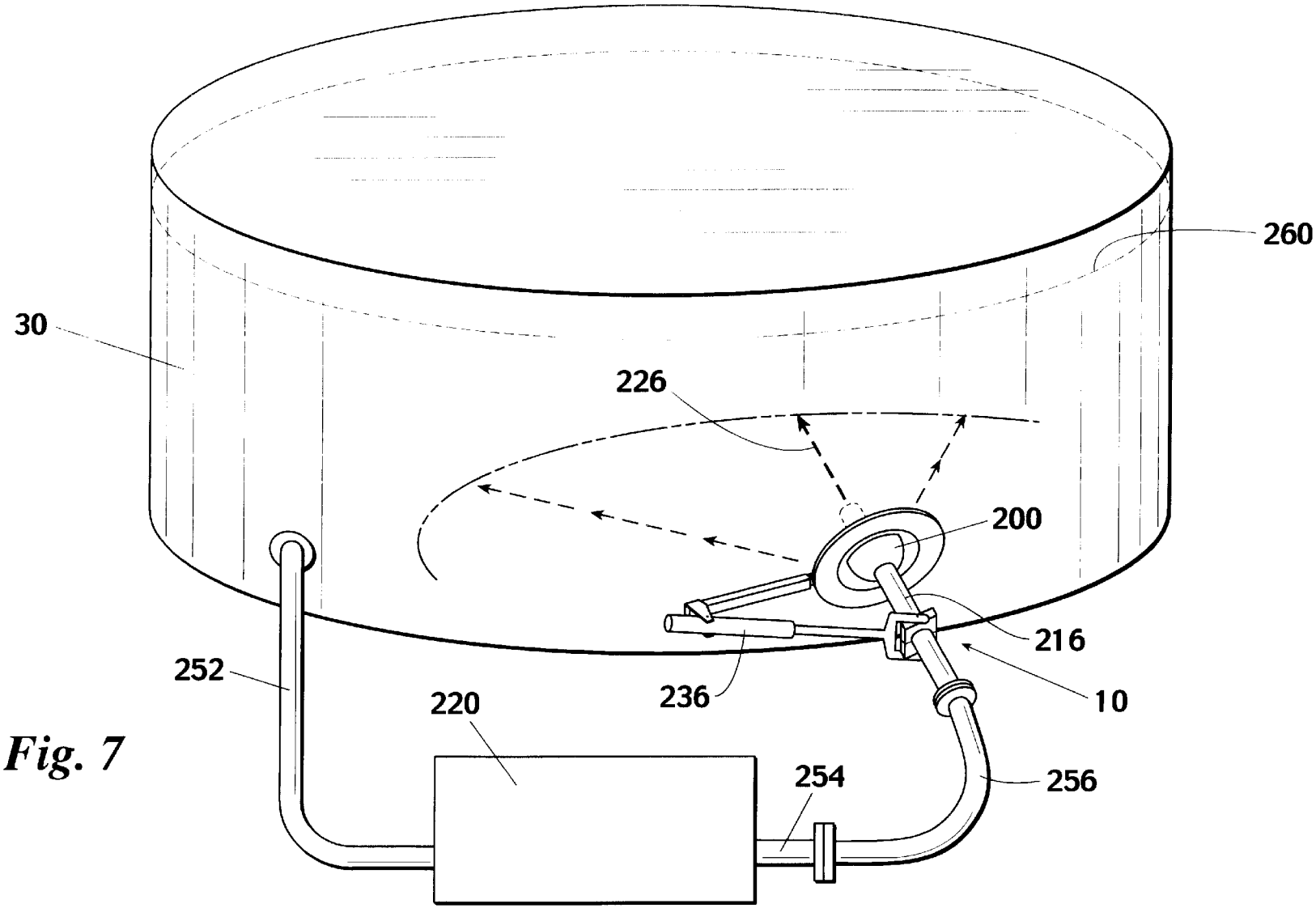
FIG. 7 is a schematic representation of another embodiment of a tank cleaning apparatus of the present invention installed on a crude oil tank for operation.
Figure 8:
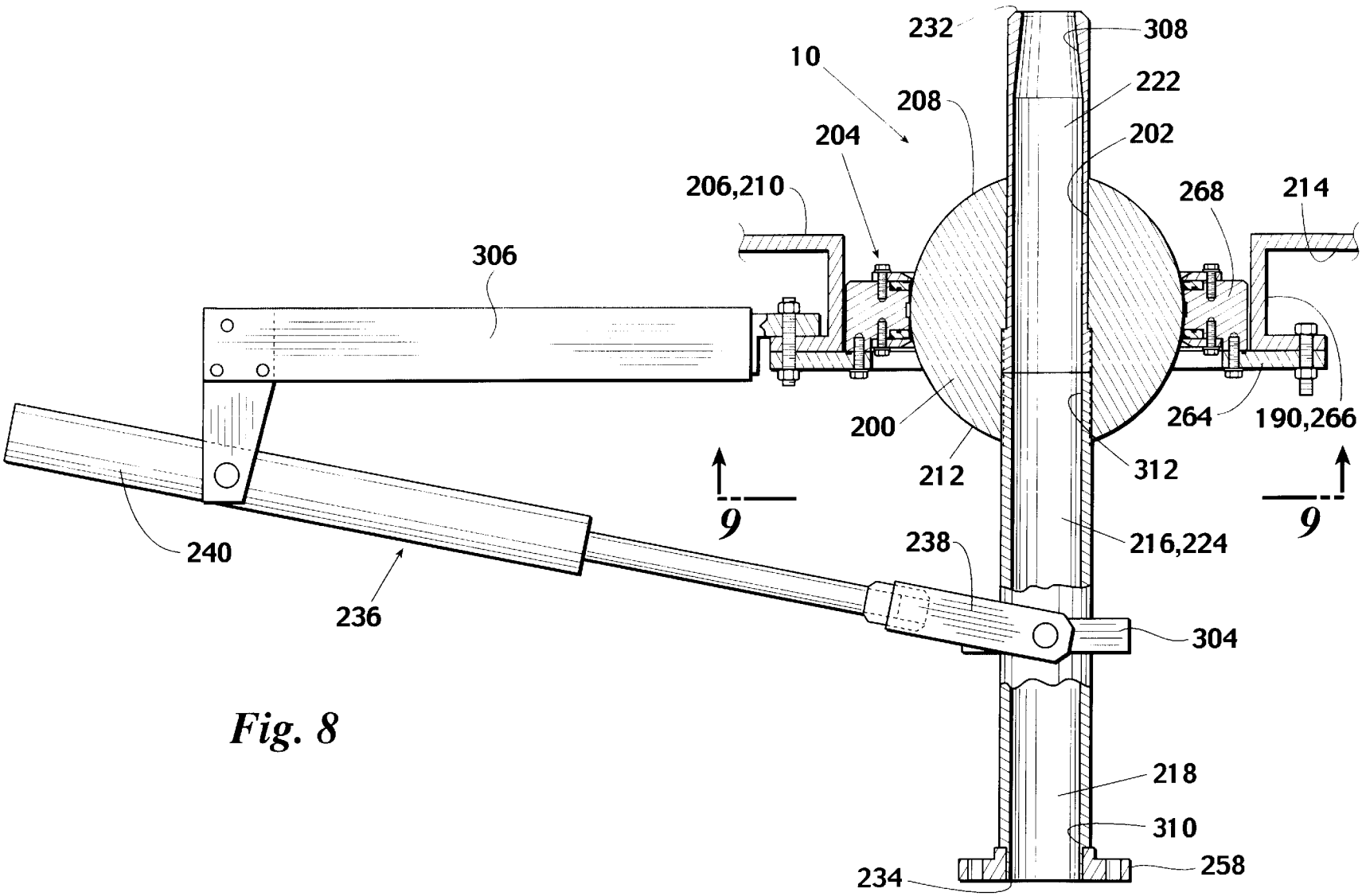
FIG. 8 is a top view in partial section of the tank cleaning apparatus of FIG. 7.

Referring now to the example of FIGS. 7–11, a more preferred embodiment of the sludge removal system 10, also referred to as a crude oil tank cleaning apparatus 10, will be described. Referring to FIG. 7, the crude oil tank cleaning apparatus 10 is used for directing a high velocity stream or jet 226 of fluid into the tank 30 in order to resuspend or remove sludge from the tank 30. Referring to FIG. 8, the apparatus 10 may be generally described as comprising a gimbal 200 having a substantially straight passageway 202 extending through the gimbal; a mounting bracket 204 for sealingly and rotatably mounting the gimbal 200 in a wall 206 of the tank 190 so that the gimbal 200 has an interior side 208 exposed to the interior 210 of the tank 190 and an exterior side 212 exposed to the exterior 214 of the tank 190; and a straight length of pipe 216 sealingly mounted in the gimbal passageway 202.

The pipe 216 has an inlet end 218 on the exterior side 212 of the gimbal 200 for connecting the pipe 216 to a high pressure fluid source 220 (best seen in FIG. 7)and an outlet end 222 on the interior side 208 of the gimbal 200. The inlet and outlet ends 218, 222 of the pipe define a linear flow passageway 224 through the pipe 216 for discharging the fluid in a fluid jet 226 into the tank 190 so that the fluid jet 226 (FIG. 7) is about collinear with the flow passageway 224.

In the preferred embodiment, the pipe discharges the fluid in a high velocity, laminar flow stream. The pipe 216 is designed and sized to laminarize the fluid discharged from the pipe 216. This may be accomplished by using flow straightening vanes inside the flow passageway 224 of the pipe 216. In the preferred embodiment, the flow laminarization is achieved by sizing the straight pipe 216 so that the length of the pipe 216 from the interior terminus 232 of the outlet end 222 to the exterior terminus 234 of the inlet end 218 is at least twenty pipe diameters. As exemplified in FIG. 8, the outlet end 222 of the pipe 216 extends beyond the gimbal 200 and defines the interior terminus 232 of the pipe on the interior side 208 of the gimbal 200, the inlet end 218 of the pipe 216 extends beyond the gimbal 200 and defines the exterior terminus 234 of the pipe on the exterior side 212 of the gimbal 200, and the pipe 216 is straight between the interior terminus 232 and the exterior terminus 234.

Referring to the example of FIG. 8, the gimbal 200 is spherically shaped. More preferably, the gimbal 200 is a sphere of solid material, such as mild steel.

Figure 9:
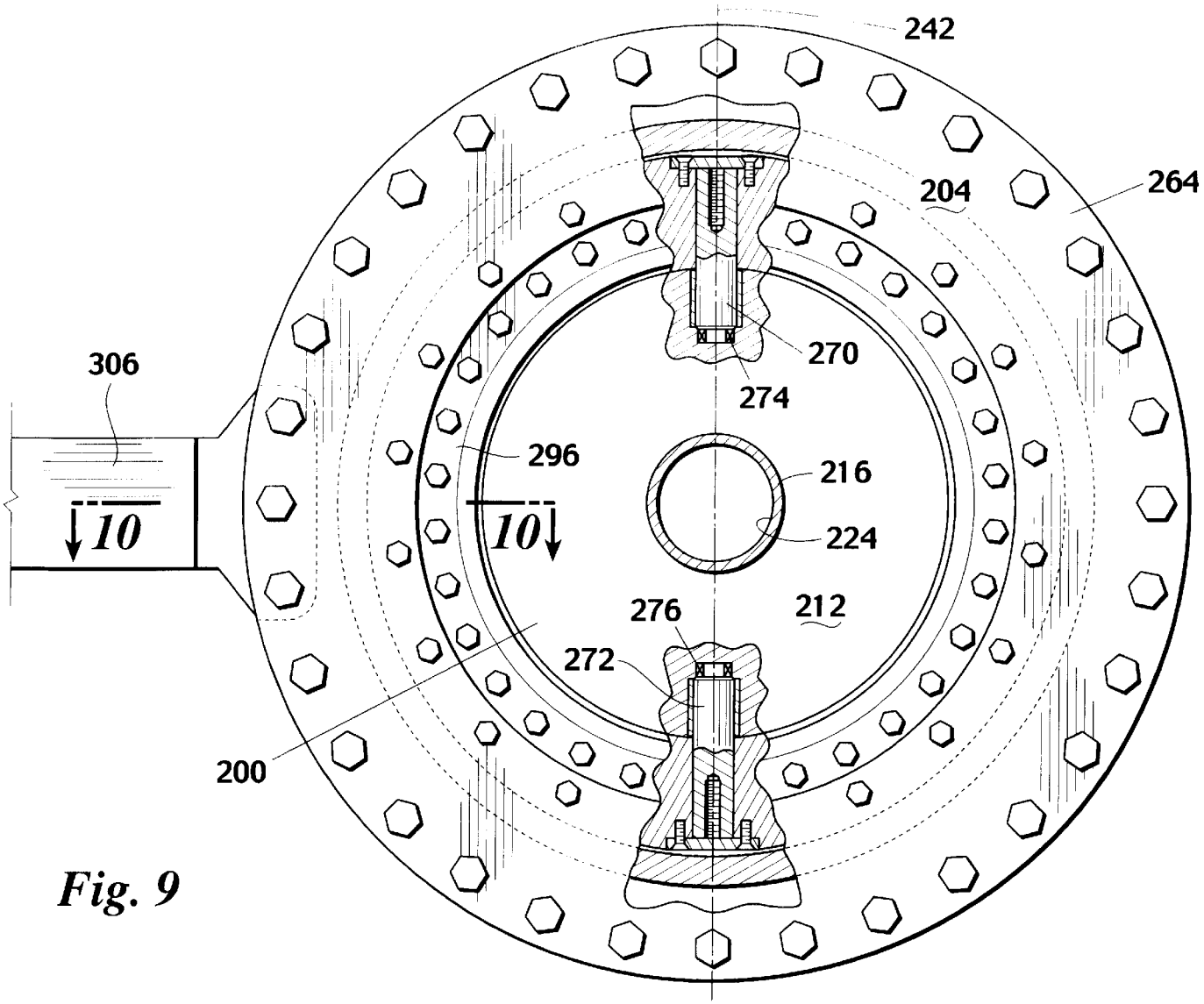
FIG. 9 is a view along line 9—9 of FIG. 8.

Referring to the example of FIG. 8, the preferred apparatus 10 includes an actuator 236 for reciprocating the gimbal 200 and pipe 216 between selected positions. The actuator has a first end 238 connected to a rotatable portion of the gimbal 200 and a second end 240 connected to a stationary portion of at least one of the tank 190 or the mounting bracket 204. Preferably, the first end 238 of the actuator 236 is connected to the exterior side 212 of the gimbal 200 and the second end 240 of the actuator 236 is connected on the exterior side 214 of the tank 190 so that the interior side 208 of the gimbal 200 and the outlet end 222 of the pipe 216 are the only moving components of the apparatus 10 exposed to the interior of the tank 190. The actuator 236 may be used to reciprocate the gimbal 200 and pipe 216 about a selected axis. In the prototype apparatus 10, the actuator 236 reciprocates the gimbal 200 and pipe 216 about a vertical axis 242 (FIG. 9).

Preferably, the actuator 236 reciprocates the gimbal 200 in pipe 216 through an arc of at least 120°. The preferred actuator 236 allows adjustment of the length of stroke of the actuator, thereby allowing the operator to preselect the arc through which the gimbal 200 and pipe 216 reciprocate. The mounting bracket 204 may be used to adjust the position of the gimbal 200 in the manway 266, i.e., to position the gimbal 200 toward and away from the interior of the tank, if the wall 206 of the tank is limiting the sweep angle of the apparatus 10. Preferably, the actuator 236 also includes a variable timer so that the operator may select the oscillation time of the apparatus 10.

On small tanks, the actuator 236 may be eliminated. The gimbal 200 may be fixedly positioned to angle the discharge of the pipe 216 and fluid jet 226 into the tank and create a cyclonic flow of fluid in the tank. On large tanks 190, multiple tank cleaning apparatus 10 may be installed at intervals around the tank in order to shorten the cleaning time or to enhance the efficiency of the cleaning apparatus 10.

As previously mentioned, the duration or cycle time of the preferred apparatus 10 is a selectable function which may be varied depending on the application. Factors which influence the optimal cycle time of the apparatus 10 include the viscosity of the oil in the tank, the density of the sludge, the accumulation depth of the sludge, and whether the sludge has accumulated to a depth above the elevation of the apparatus 10.

Referring to the example of FIG. 7, the preferred high pressure fluid source is a pump 220 located outside of the tank 10. Preferably the pump includes an intake 252 connected to the tank 190 so that the apparatus 10 uses fluid from the tank to resuspend and remove sludge from the tank. The preferred intake 252 is a pipe which connects the pump to an existing connection, such as a manway 266, on the tank 190. In the prototype apparatus 10, the pump discharges through a discharge pipe 254 which extends to approximately the midpoint of the arc defined by the horizontal motion of the exterior terminus 234 of the pipe 216. A flexible hose 256 is used to connect the discharge pipe 254 to the exterior terminus 234 of the pipe 216 in order to allow the horizontal motion of the pipe 216. Since pressure loss is greater in flexible hose than in pipe, the length of the flex hose 256 should be kept to a minimum in order to keep the pressure loss between the pump 220 and the pipe 216 to a minimum.

In the prototype apparatus 10, a flange 258 is provided at the exterior terminus 234 of the pipe 216. Although not illustrated in FIG. 7, normally a ball valve (such as ball valve 46 shown in FIG. 2) will be connected to the flange 258, and a gate valve will be connected between the ball valve and the flex hose 256 to allow the flex hose 256, discharge pipe 254, pump 220, and intake pipe 252 to be removed from the tank 190, and to allow the gimbal 200 and pipe 216 to be placed in a dormant status, as will be further discussed below.

In the preferred apparatus 10, the mounting bracket 204 is mounted in an existing manway 266 of a crude oil tank below the normal crude oil level 260 in the tank so that the gimbal 200 and pipe 216 are below the crude oil level in the tank, and may even be below the level of sludge accumulation in the tank. Referring to FIGS. 8 and 9, in the prototype apparatus 10, the mounting bracket 204 includes an annular flange 264 for bolting the apparatus 10 in a manway 266 of tank 190. An annular gimbal frame 268 fastens the gimbal 200 to the flange 264. The gimbal 200 is rotatably mounted in the gimbal frame 268 with upper and lower pivot pins 270, 272. Upper and lower bearings 274, 276 are provided between the upper and lower pivot pins 270, 272, respectively, and the gimbal 200.

Figure 10:
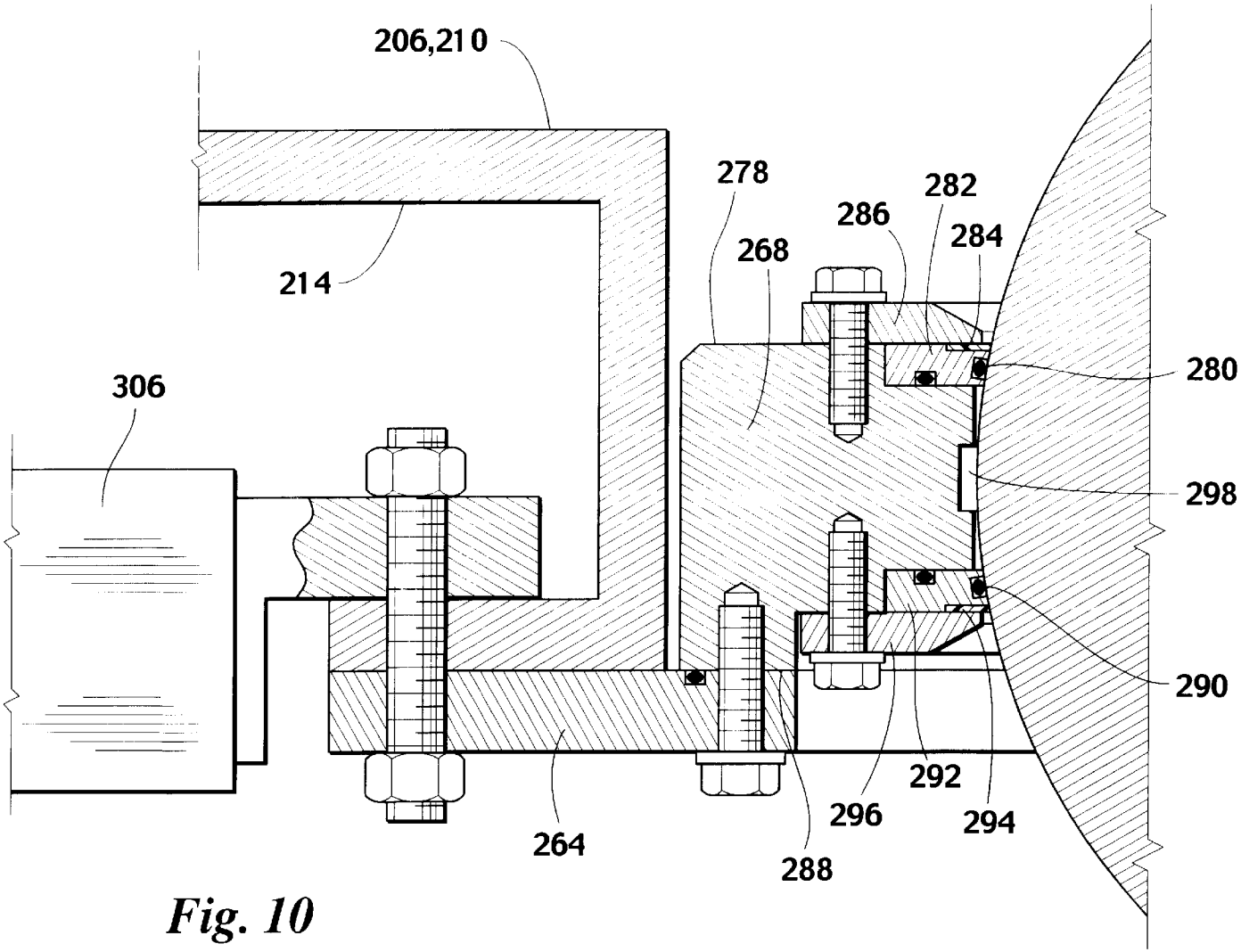
FIG. 10 is view along line 10—10 of FIG. 9.

Referring to the example of FIG. 10, in order to seal the interface between the contents of the tank 190 and the exterior 214 of the tank, the interior side 278 of the gimbal frame 268 includes an o-ring seal 280 held in place by a retainer ring 282, teflon wiper ring 284 and wiper retainer ring 286. Similarly, the exterior side 288 is sealed with o-ring 290, retaining ring 292, teflon wiper ring 294, and wiper retainer ring 296. As would be known to one skilled in the art, appropriate seals are also used between the flange 264 and manway 266, as well as between the gimbal frame 268 and flange 264. A grease cavity 298 is provided between the gimbal frame 268 and the gimbal 200 to complete the seal and lubricate the interface between the o-rings 280, 290 and the gimbal 200.

Normally the flange 264 is mounted in a manway 266 with the pivot pins 270, 272 in vertical alignment to allow reciprocation of the gimbal 200 and pipe 216 in a horizontal plane. In the prototype apparatus 10, the first end 238 of actuator 236 is connected to the pipe 216 outside of the tank 190 with pipe bracket 304. The second end 240 of the actuator 236 is connected to the manway 266 with support arm 306. The actuator 236 is preferably a hydraulically powered piston-cylinder-type actuator, but may be any type of linear actuator, including pneumatically and electrically powered devices, as would be known to one skilled in the art in view of the disclosure contained herein.

Referring to the example of FIG. 8, in the preferred embodiment, the inlet end 218 and outlet end 222 of the straight pipe 216 are separate sections of pipe. The inlet end 218 has a nozzle 308 adjacent the interior terminus 232. The nozzle 308 is integrally formed in the inlet end 218 of the preferred embodiment, although it may be made as a separable component. The nozzle 308 serves to accelerate the velocity of the laminar fluid jet as it is discharged into the tank 190.

Referring to the example of FIG. 8, the inlet end 218 of the pipe 216 has a first end 310 and a second end 312 which is threaded into the gimbal passageway 202. As previously mentioned, when the first end 310 is fully threaded into the gimbal passageway, the distance from the interior terminus 232 of the inlet end 218 to the exterior terminus 234 of the outlet end 222 should be at least twenty times the inside diameter of the flow passageway. In the prototype apparatus 10, the internal diameter of the flow passageway 224 is four inches and the distance from the interior terminus 232 to the exterior terminus 234 of the pipe 216 is eighty inches. The opening at the small end of the nozzle 308 is three inches in diameter, and the nozzle is five inches long along the axis of the flow passageway 224.

Figure 11:
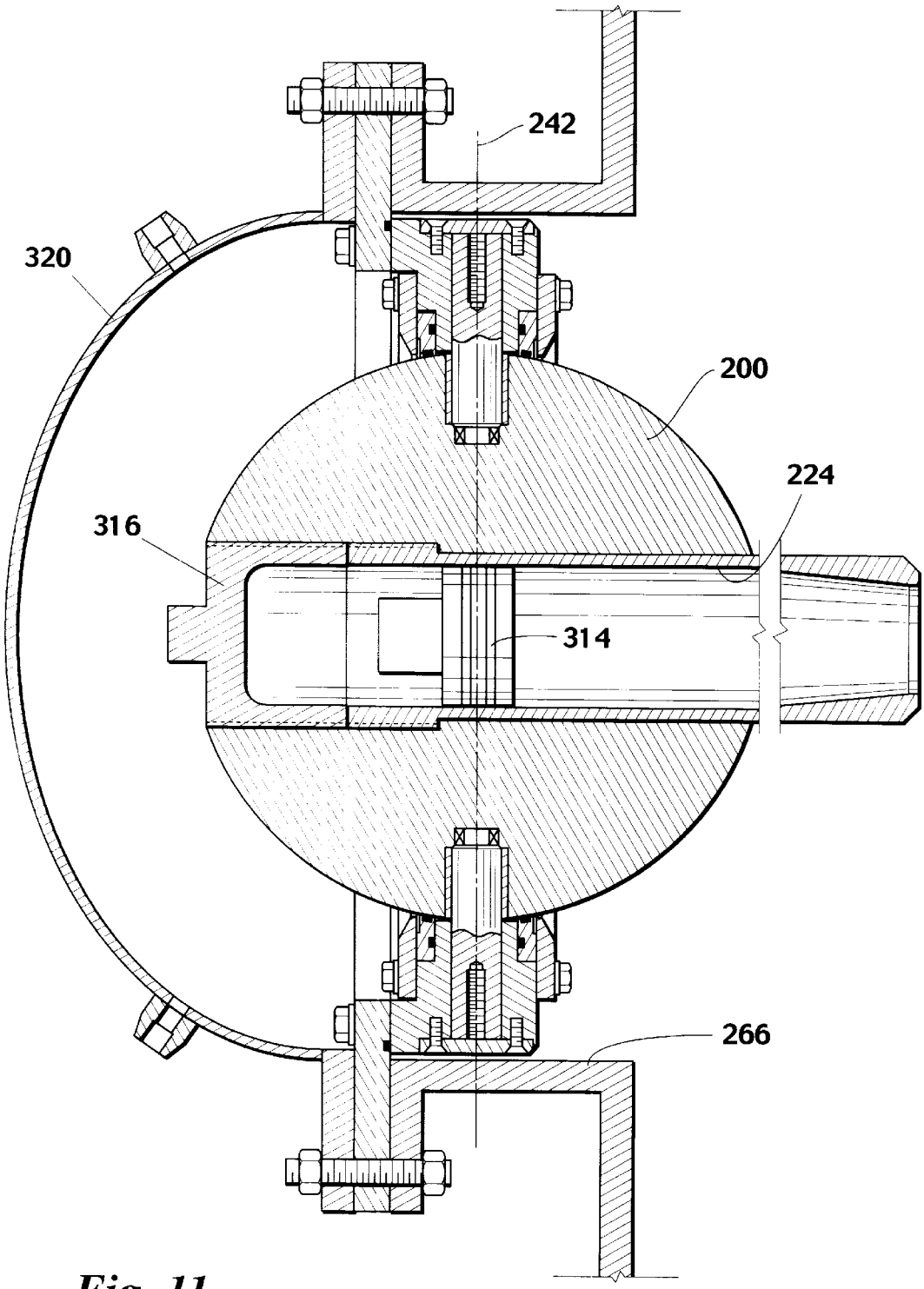
FIG. 11 is a side sectional view of an embodiment of the tank cleaning apparatus of FIG. 7 in its dormant state.

FIG. 11, illustrates the apparatus 10 in its dormant status. It is contemplated that many tank operators will leave the gimbal 200 permanently mounted in a manway 266 so that the tank may be periodically cleaned or desludged without taking the tank out of operation. Referring to the example of FIG. 8, which illustrates the apparatus 10 in its active configuration, when it is desired to deactivate the apparatus 10, a bridge plug 314 (seen in FIG. 11) is inserted into the inlet end 218 of the straight pipe 216 and expanded to seal the flow passageway 224. The bridge plug 314 is inserted through the ball valve previously mentioned, as would be known to one skilled in the art in view of the disclosure contained herein. After the bridge plug 314 is installed, the actuator 236 is removed, and the inlet end 218 of the pipe 216 is unthreaded and removed from the gimbal passageway 202. Referring to FIG. 11, a gimbal plug 316 is then threaded into the gimbal passageway to provide a second level of sealing outside of the bridge plug 314. A manway cover 320 is then bolted to the manway over the gimbal 200 and gimbal frame 268 to provide a third level of sealing. The pump 220, intake pipe 252, discharge pipe 254, and flex hose 256 (FIG. 7) may then be removed from the tank area. The tank then remains in normal operation with the gimbal 200 in its dormant state. When it is desired to clean or desludge the tank 190 at a subsequent time, the manway cover 320 is removed, the gimbal plug 316 is removed, the inlet end 218 of the pipe 216 is threaded into the gimbal passageway, the ball valve and gate valve are reinstalled, the bridge plug 314 is removed, and the pump 220 is reconnected to the pipe 216 as previously described.

Although preferred embodiments of the invention are illustrated in the accompanying Drawings and described in the foregoing Detailed Description, it will be understood that the invention is not limited to the embodiments disclosed, but is capable of numerous rearrangements, modifications, and substitutions of parts and elements without departing from the spirt of the invention.

What is claimed is:

1. Crude oil tank cleaning apparatus for directing a high velocity stream of fluid into the tank in order to resuspend or remove sludge from the tank, comprising:

a gimbal having a substantially straight passageway extending therethrough;

a mounting bracket for sealingly and rotatably mounting the gimbal in a wall of the tank so that the gimbal has an interior side exposed to the interior of the tank and an exterior side exposed to the exterior of the tank; and a straight pipe sealingly mounted in the gimbal passageway, the pipe having an inlet end on the exterior side of the gimbal for connecting the pipe to a high pressure fluid source and an outlet end on the interior side of the gimbal, the inlet and outlet ends defining a linear flow passageway through the pipe for discharging the fluid in a fluid jet into the tank, the fluid jet being about collinear with the flow passageway, the flow passageway being straight for at least twenty pipe diameters from the outlet end in order to discharge the fluid in a high velocity, laminar flow stream.

2. Apparatus of claim 1:

wherein the pipe is further defined as discharging the fluid in a high velocity, laminar flow stream.

3. Apparatus of claim 1:

wherein the pipe is sized to laminarize the fluid discharged from the pipe.

4. Apparatus of claim 1:

wherein the outlet end of the pipe extends beyond the gimbal and defines the interior terminus of the pipe on the interior side of the gimbal, the inlet end of the pipe extends beyond the gimbal and defines the exterior terminus of the pipe on the exterior side of the gimbal, and the pipe is straight between the interior terminus and the exterior terminus.

5. Apparatus of claim 1 in which the gimbal comprises:

a sphere.

6. Apparatus of claim 1 in which the gimbal comprises:

a solid sphere.

7. Apparatus of claim 1:

wherein the gimbal is mounted below the normal crude oil level in the tank.

8. Apparatus of claim 7:

wherein the gimbal is permanently mounted on the tank.

9. Apparatus of claim 1 comprising:

an actuator, having a first end connected to a rotatable portion of the gimbal and a second end connected to a stationary portion of at least one of the tank or the mounting bracket, for reciprocating the gimbal and the pipe between selected positions.

10. Apparatus of claim 9:

wherein the actuator reciprocates the gimbal and pipe about a selected axis.

11. Apparatus of claim 10:

wherein the actuator reciprocates the gimbal and pipe about a vertical axis.

12. Apparatus of claim 9:

wherein the first end of the actuator is connected to the exterior side of the gimbal and the second end of the actuator is connected on the exterior side of the tank, so that the entire actuator is on the exterior side of the tank, the interior side of the gimbal and the outlet end of the pipe being the only moving components of the apparatus exposed to the interior of the tank.

13. Apparatus of claim 1 in which the high pressure fluid source comprises:

a pump located outside of the tank.

14. Apparatus of claim 13 in which the pump comprises:

an intake connected to the tank so that the apparatus uses fluid from the tank to resuspend and remove sludge from the tank.

15. Crude oil tank cleaning apparatus for directing a high velocity stream of fluid from outside the tank into the tank while the tank is in service in order to resuspend or remove sludge from the tank, comprising:

a gimbal having a substantially straight passageway extending therethrough;

a mounting bracket for sealingly and rotatably mounting the gimbal in a wall of the tank so that the gimbal has an interior side exposed to the interior of the tank and an exterior side exposed to the exterior of the tank;

a straight pipe sealingly mounted in the gimbal passageway, the pipe having an inlet end on the exterior of the gimbal for connecting the pipe to a high pressure fluid source and an outlet end on the interior side of the gimbal, the inlet and outlet ends defining a linear flow passageway through the pipe for discharging the fluid in fluid jet into the tank, the flow passageway being straight for at least twenty pipe diameters from the outlet end in order to discharge the fluid in a high velocity, laminar flow stream; and an actuator, having a first end connected to the exterior side of a rotatable portion of the gimbal and a second end connected to a stationary portion of at least one of the tank or the mounting bracket on the exterior side of the tank, for reciprocating the gimbal and the pipe between selected positions.

16. Apparatus of claim 15:

wherein the gimbal is mounted below the normal crude oil level in the tank.

* * * * *